United States Patent [19]

Garcia et al.

[11] 4,278,257

[45] Jul. 14, 1981

[54] SOCCER KICKING AID

[76] Inventors: Juan M. Garcia, c/o George Spector, 3615 Woolworth Bldg., 233 Broadway; George Spector, 3615 Woolworth Bldg., 233 Broadway, both of New York, N.Y. 10007

[21] Appl. No.: 119,384

[22] Filed: Feb. 7, 1980

[51] Int. Cl.[3] ..... A63B 69/00

[52] U.S. Cl. ..... 273/411; 273/413; 273/58 C; 273/DIG. 21; 242/54 R

[58] Field of Search ..... 273/411, 413, 26 E, 273/58 C, 184 B, 185 C, 185 D, 196, 197 R, 197 A, 198, 200 R, 200 B, 208, DIG. 21; 242/54 R

[56] References Cited

U.S. PATENT DOCUMENTS

| | | | |
|---|---|---|---|
| 3,168,312 | 2/1965 | Davis | 273/26 E |
| 3,191,880 | 6/1965 | Visconti | 242/54 R |
| 3,498,613 | 3/1970 | Dreyer | 273/413 |
| 3,707,268 | 12/1972 | Kelly | 242/54 R |
| 3,735,934 | 5/1973 | Black | 242/54 R |
| 3,876,162 | 4/1975 | Chun et al. | 242/54 R |
| 4,158,458 | 6/1979 | Gomez | 273/413 |

FOREIGN PATENT DOCUMENTS

| | | | |
|---|---|---|---|
| 17503 | 7/1935 | Australia | 273/200 R |
| 2600462 | 7/1977 | Fed. Rep. of Germany | 273/411 |
| 2105389 | 4/1972 | France | 273/411 |
| 392412 | 5/1933 | United Kingdom | 273/200 R |
| 413354 | 7/1934 | United Kingdom | 273/413 |
| 838470 | 6/1960 | United Kingdom | 273/411 |

*Primary Examiner*—William H. Grieb

[57] ABSTRACT

A pair of goal posts spaced apart up to two hundred feet, each post including a hollow construction containing a reel of cord dispensed from an upward hose on top and the outer end of the cord being tied to a soccer ball, the upper end of the post being swivelled on a thrust bearing, and ropes around the side of the post being tied to stakes driven into the ground.

3 Claims, 5 Drawing Figures

SOCCER KICKING AID

This invention relates generally to soccer game practice accessories.

It is well known that numerous aids have been developed for athletes doing practice work. Many of such aids serve to help the athlete conserve his energy, doing other chores, such as retrieving a ball after he has thrown it. However, no such aid has as yet been provided for soccer players while practicing the kicking of a soccer ball.

Accordingly, it is a principal object of the present invention to provide a soccer kicking aid in which the ball is tethered to a line so that it can be retrieved by being pulled back, after having been kicked.

Another object is to provide a soccer kicking aid which accordingly is idea for a player practicing alone, and which will enable the player to improve his kicks, such as direct kicks, indirect kicks, corner kicks and the like, the kicks being made toward a goal at a specific distance away.

Figures 1, 2, 2A, 3, 4:
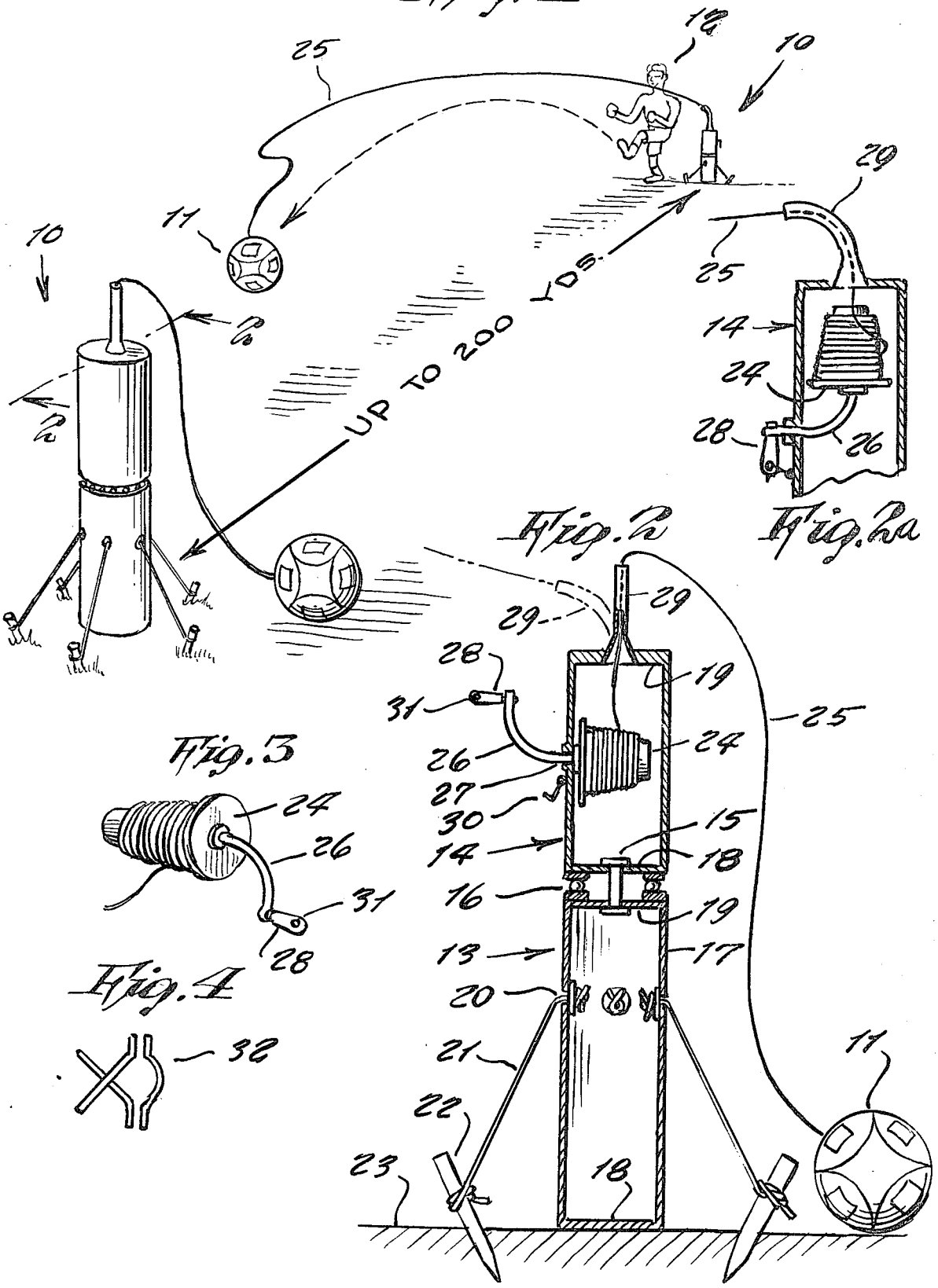
FIG. 1 is a perspective view of the invention shown in use.
FIG. 2 is a cross sectional view on line 2—2 of one of the goal posts shown in FIG. 1.

FIG. 2*a* is a fragmentary view similar to FIG. 2 and showing the other goal post of FIG. 1 which is in operative use.

FIG. 3 is a perspective view of the cord reel.

FIG. 4 is an end view of the brake guide of the device.

Referring now to the drawing in greater detail, the reference numeral 10 represents a soccer kicking aid according to the present invention which comprises a goal post to which a soccer ball 11 is tethered and which may be kicked by a soccer player 12 which practicing the game kicks so that he may improve himself. In such practice, two such goal posts may be employed, as shown in FIG. 1, so that each serves as a goal for the other.

The goal post includes an upright hollow base 13 upon which an upright hollow extension 14 is mounted by means of a central, vertical single rivet or bolt 15 therebetween so the extension may served thereupon. A thrust bearing 16 between the base and extension provides to make such swivelling relatively friction free.

The base and the extension are each made preferably from a light weight metal such as aluminum or steel so to be strong and be able to withstand the stress of forces thereagainst. Each includes a cylindrical side wall 17 and opposite bottom and top walls 18 and 19.

The base has a row of holes 20 around its side so that ropes 21 tethered therein can extend outward and be tied to stakes 22 driven into the ground 23 so as to firmly hold the post upright.

A winch or reel 24 contained inside the extension serves for a length of nylon cord 25 to be wound up therearound. The reel has a 90 degree, arcuate crank arm 26 extending outward of a hole 27 in the side wall, and the end of the crank arm has a handle 28 rotatable thereupon. The cord extends from the reel upwardly through a flexible rubber hose 29 extending through the extension top wall, and the outer end of the cord is fastened to the soccer ball 11.

When the cord is intended to be reeled up on the line, the crank arm is pulled outwardly until the reel is along a horizontal central axis, as shown in FIG. 2. Thus, turning the crank arm causes the cord to be wound up.

When the player is ready to kick the ball, the crank arm is pushed inward so that the reel is pushed upwardly, as shown in FIG. 2*a* so that it is along a vertical central axis. This position of the reel allows the cord to be easily paid out therefrom without necessity of the reel being rotated, so that the paid out line is not held back by a rotating reel, and the kicked soccer ball can thus travel further. A latch 30 latches to a hole 31 in handle 28 as shown in FIG. 2*a* so to hold the reel in the vertical position.

A brake guide 32 shown in FIG. 4 may be incorporated into the construction.

What is claimed as new, is:

1. A soccer kicking aid, comprising in combination, a vertical goal post including a hollow base and a hollow extension swivelled thereupon, said hollow extension containing a reel therein, a nylon cord wound around said reel, said cord extending outward through a flexible hose on top of said extension and being tethered to a soccer ball.

2. The combination as set forth in claim 1, wherein a crank arm of said reel extends outward of a bearing hole in a sidewall of said extension said crank arm being arcuate in shape and slidable in said hole.

3. The combination as set forth in claim 2, wherein a plurality of ropes from a sidewall of said base are tethered to stakes driven in a ground.

* * * * *